United States Patent [19]

Bartky et al.

[11] Patent Number: 4,973,981

[45] Date of Patent: Nov. 27, 1990

[54] METHOD OF TESTING COMPONENTS OF PULSED DROPLET DEPOSITION APPARATUS

[75] Inventors: W. Scott Bartky, Chicago, Ill.; Anthony D. Paton, Cambridge, England

[73] Assignee: AM International, Inc., Chicago, Ill.

[21] Appl. No.: 459,006

[22] Filed: Dec. 29, 1989

[30] Foreign Application Priority Data

Dec. 30, 1988 [GB] United Kingdom ..... 8830399

[51] Int. Cl.[5] ..... B41J 2/045

[52] U.S. Cl. ..... 346/1.1; 324/727; 346/140 R

[58] Field of Search ..... 346/1.1, 140; 340/727; 310/316

[56] References Cited

U.S. PATENT DOCUMENTS 4,879,568 11/1989 Bartky et al. ..... 346/140

4,887,100 12/1989 Michaelis et al. ..... 346/140

FOREIGN PATENT DOCUMENTS 1465825 3/1989 U.S.S.R. ..... 324/727

*Primary Examiner*—Joseph W. Hartary

*Assistant Examiner*—Alrick Bobb

[57] ABSTRACT

A method for testing body components of pulsed droplet deposition apparatus comprises applying a variable frequency voltage to the electrodes of each of a number of selected channel wall elements. The resulting impedance variations are used to determine the natural frequencies of the selected wall elements which, in turn, are used to determine whether the compliance ratios of the selected wall elements and the droplet liquid to be used therewith lies within a desired range of values.

12 Claims, 1 Drawing Sheet

METHOD OF TESTING COMPONENTS OF PULSED DROPLET DEPOSITION APPARATUS

CROSS-REFERENCE TO RELATED APPLICATIONS

This application is related to application Ser. No. 140,617, filed Jan. 4, 1988, in the names of A. J. Michaelis, A. D. Paton, S. Temple and W. S. Bartky, entitled "Droplet Deposition Apparatus", now U.S. Pat. No. 4,887,100 and application Ser. No. 140,764, filed Jan. 4, 1988, in the names W. S. Bartky, A. D. Paton, S. Temple and A. J. Michaelis, entitled "Droplet Deposition Apparatus," now U.S. Pat. No. 4,879,569 both of which applications are incorporated herein by reference and are assigned to the assignee of the present application.

BACKGROUND OF THE INVENTION

The present invention relates in general to a method of testing body components of pulsed droplet deposition apparatus. The body components with which the invention is particularly concerned each comprise a sheet of piezoelectric material formed with a multiplicity of parallel channels having upstanding channel dividing side wall elements poled in a direction normal to said sheet and each plated on opposite channel facing wall surfaces thereof with electrodes.

The related patent applications describe various forms of pulsed droplet deposition apparatus. One form described employs a body component of the kind referred to above and a further body component comprising a sheet of inactive material bonded to the free ends of the channel dividing side walls to form the channel array, the channels of which are of rectangular transverse cross-section. In this form, the channel dividing side walls form monolithic cantilever actuators which are displaceable by electrical impulses applied to their electrodes to impart pressure impulses to droplet liquid in the channels for effecting droplet ejection from the channels. Such droplet ejection takes place through nozzles which communicate with the respective channels of the array.

In another form of droplet deposition apparatus described in the related patent applications, the channel dividing side walls of two like body components are bonded together at the free ends thereof to form the channel array. In this form of channel array, a voltage impulse applied to the electrodes of the channel dividing side walls deflect the side walls in shear mode into chevron formation. Pressure pulses are thereby imparted to the droplet liquid in the channels into which said channel dividing side walls are deflected for ejection of droplets from the respective channels of the array.

In both of the forms of pulsed droplet deposition apparatus, which in practice are drop-on-demand ink jet printers, each channel dividing wall actuator may serve both channels on opposite sides thereof; that is to say, each can be deflected in opposite senses to effect droplet ejection from the respective channels on opposite sides thereof.

It will be apparent that body components of the kind referred to above are vital components of the pulsed droplet deposition apparatus described in the related patent applications. It is important therefore that a procedure for reliably testing such body components in the initial stages of the manufacturing process be available so that early rejection of imperfect specimens can take place.

OBJECTS OF THE INVENTION

It is therefore a basic object of the present invention to provide a novel method for testing body components of pulsed droplet deposition apparatus.

It is a further object of the invention to provide such a testing method which allows for reliable testing of body components in the initial stages of the manufacturing process It is yet another object of the invention to provide such a testing method which is both nondestructive and which can be performed rapidly and at a minimum expense.

In accordance with these and other objects, a method for testing body components of pulsed droplet deposition apparatus comprises applying a variable frequency voltage to the electrodes of each of a number of selected wall elements of a body component, measuring the resulting impedance variations of the selected wall elements, determining the natural frequency of the selected wall elements from the measured impedance variations and determining from the natural frequencies whether the compliance ratios of the selected wall elements and the droplet liquid to be used therewith lie within a desired range of values. A similar procedure may be performed at a subsequent stage of the manufacturing process after a further member has been bonded to the free ends of the side wall elements of the body components.

BRIEF DESCRIPTION OF THE DRAWINGS

These and other objects and advantages of the invention will be apparent upon reading the following description in conjunction with the drawings, in which.

DESCRIPTION OF THE PREFERRED EMBODIMENTS

Figure 1:
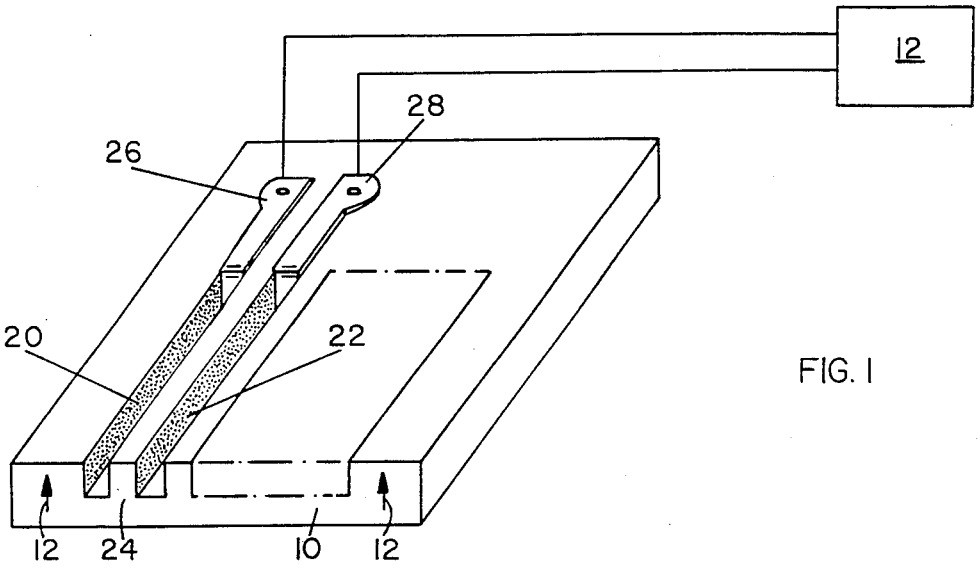
FIG. 1 is a perspective view of a body component of a pulsed droplet deposition apparatus under test according to the invention.

Referring to the drawings, FIG. 1 shows a body component 10 formed from a sheet of piezo-electric material, suitably PZT, poled in a direction normal to the sheet as indicated by arrows 12. Although component 10 is shown as a monolithic sheet of piezo-electric material, it may instead comprise a laminate including a sheet of piezo-electric material and a substrate of inactive material. An array of parallel channels 20,22 is formed in the piezo-electric material which, where a laminate is used, may extend through the piezo-electric layer and partially into the inactive substrate. Between each pair of channels 20,22 is thus provided an upstanding channel dividing wall 24. Each channel dividing wall 24 is plated on opposite channel facing surfaces thereof with conductive material to provide electrodes to which a voltage can be applied to selectively deflect the wall 24 in shear mode in opposite senses into the respective channels on opposite sides thereof.

Figure 2A:
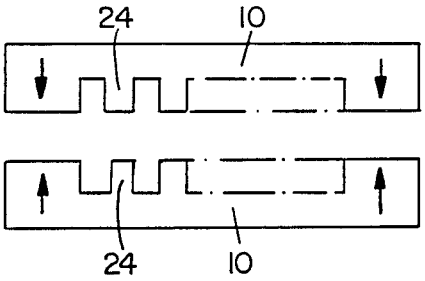
FIG. 2A is a sectional view of two like body components after testing and prior to bonding together of the channel dividing walls thereof to form part of the channel array of the printhead of a printer.
Figure 2B:
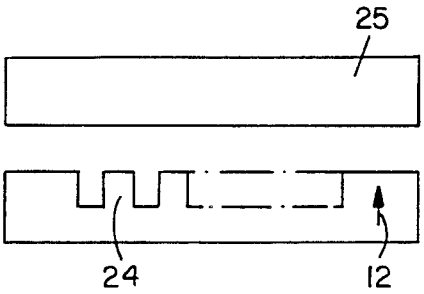
FIG. 2B is a view similar to FIG. 2A of a body component and a sheet of inactive material prior to bonding.

The component 10 can be employed with a sheet of inactive material 25 bonded to the free ends of the walls 24 as shown in FIG. 2B to provide an array of channels of rectangular transverse cross-section of which the dividing walls are cantilever actuators. Component 10 can also be bonded, as indicated in FIG. 2A, to a like component to provide an array of channels of rectangular transverse cross-section of which the dividing walls comprise actuators which are deflectable into chevron-like form.

An important design parameter utilized in the development of drop-on-demand printheads employing shared wall actuators as described above is that of compliance ratio (CR). This quantity is the ratio of the compliance of each channel dividing wall actuator to that of the ink in the ink channels of the array. Thus CR=CW/CI. This value has been found to influence:

(a) the velocity of sound at which the acoustic waves giving rise to droplet ejection travels in the ink channels;

(b) the degree of pressure cross-talk - i.e. the effect on the ink pressure in one actuated channel of a neighboring channel or channels being actuated at the same time; and (c) the coupling efficiency between the voltage applied to the electrodes of an actuator and the velocity of an ejected ink droplet.

If a value of CR close to zero is adopted, so that the actuator walls are virtually rigid, the velocity of sound is ostensibly that in the ink alone, and the cross-talk coupled into the neighboring channel is negligible. Despite these simplifications such a design is unattractive because it requires high values of wall and channel width in the array direction, that is to say the direction normal to the channel axes and in the plane thereof. As a consequence relatively high actuating voltages are called for and the channel density is limited.

It has been found that compliance ratios in the range $0.3 \leqq CR \leqq 3$ give satisfactory results with optimum results being achieved in the range $0.5 \leqq CR \leqq 0.67$. Values in this latter range give the most efficient coupling between applied voltage and drop velocity, independent of the scale of the printhead, i.e. the number of channels per millimeter which in high density arrays is greater than two. The preferred value within this range depends upon whether all of the channels or only one channel is actuated at the same time.

It has been deduced that a relationship exists between compliance ratio and the natural frequency of the actuator channel dividing walls which provides the basis for the method of testing body components according to the invention. This relationship is arrived at by employing Rayliegh's approximation which infers that a estimate of the natural frequency of a uniform beam—in the present case, the beams provided by the channel wall actuators—if the modal shape is unknown, can be obtained by assuming a suitable shape such as the static deflection of the beam under uniform pressure. The relationship deduced is $$CR = \frac{1}{K} \cdot \frac{1}{4\pi^2} \cdot \frac{B}{wb\rho} \cdot \frac{1}{f^2};$$

where K is a constant, typically equal to 1.5

B is the bulk modulus of the ink b is the mean width of the ink channel (i.e. the channel cross-sectional area ÷ the channel wall height)

w is the channel wall width $\rho$ is the mean density of the channel wall f is the natural frequency Using the value 1.5 for K, the relationship becomes $$CR = \frac{1}{60f^2} \frac{B}{b\rho w}; \text{ or}$$

$$f = \sqrt{\frac{B}{60CRb\rho w}} \tag{1}$$

For $0.5 \leqq CR \leqq 0.67$ this gives:

$$0.158\sqrt{\frac{B}{b\rho w}} \leqq f1 \leqq 0.183\sqrt{\frac{B}{w\rho b}}$$

where f1 is the natural frequency of the wall actuator after bonding. This can be written as follows:

$$0.158\sqrt{\frac{B}{wb\rho}} \frac{fo}{f1} \leqq fo \leqq 0.183\sqrt{\frac{B}{w\rho b}} \frac{fo}{f1} \tag{2}$$

where fo is the natural frequency of the wall actuator prior to bonding.

For $0.3 \leqq CR \leqq 3$ equation (2) can be restated to provide a wider range of acceptable values of fo.

The compliance ratio of an assembled i.e. a bonded actuator can therefore be obtained from equation (1), i.e. from its natural frequency f1 and from the properties B, b of the ink and ink channel together with the properties W,$\rho$ of the actuator wall. A prediction of the compliance ratio can be obtained before the actuator is bonded to form the channel array by measuring the natural frequency, fo, of the actuator wall after plating the electrodes thereon but before bonding.

Given a knowledge of fo/f1, a component is checked as being satisfactory for use provided fo for all of the measured wall actuators lie within the range given by equation (2) or the wider range of fo given by equation (2) for $0.3 \leqq CR \leqq 3$. A knowledge of fo/f1 can be obtained from geometrical considerations as described hereinafter or from accumulated experience of measuring fo before and f1 after bonding.

According to a further aspect of the invention, the natural frequencies of the selected wall actuators may further be evaluated to effect a comparison of the values of wall compliances with respect to each other. Thus, in addition to determining from the natural frequencies whether the compliance ratios of each selected wall actuator lies within a desired range of values as described above, a further check may be performed to determine from the natural frequencies whether the compliance ratios of the selected wall actuators lie within a predetermined range of each other. Preferably, this latter range is smaller than the former. Also, this further check is preferably effected both prior to and after the bonding stage.

Referring again to FIG. 1, testing of body components in accordance with the foregoing is facilitated by connecting the plated electrodes provided on opposite sides of wall 24 to contact pads 26,28. Contact pads 26,28 are then connected to a phase analyzer 12, for example an HP4194A manufactured by the Hewlett Packard Company. Phase analyzer 12 is employed to apply to selected or each of the walls 24 in turn a sweep frequency from which the complex impedance of the walls at resonance and anti-resonance is measured. Alternatively, the pads 26 and 28 may be connected in an impedance bridge supplied with a variable frequency.

The fundamental resonance of the wall is accordingly stimulated and detected at frequency fo by the analyzer 12 or the alternatively used impedance bridge. Since the wall 24 is free at its upper end, the measured resonant frequency of the wall is the resonant frequency in cantilever mode.

In the case of the chrevron type actuator (FIG. 2A), the component 10 may be bonded to a like component by a bond layer which is relatively compliant so that the upper walls 24 are bonded to the lower walls 24 effectively with a pin joint characteristic, which couples these walls in shear, but not in bending. The resonant frequency of the assembled printhead body part is then f1 = fo. In order to ensure that the compliance ratio will be correct after assembly a resonance check fo is first performed on both components 10 for the walls 24 of the range:

$$0.158\sqrt{\frac{B}{wb\rho}} \leqq fo \leqq 0.183\sqrt{\frac{B}{wb\rho}}$$

After bonding, if the resonant frequency of walls 24 is remeasured the same value should be obtained.

If the chevron bond layer is a rigid bond so that the bond inhibits rotation as well as shear, then the cantilever mode fo of resonance prior to bonding becomes that of a built-in beam of resonance f1 and $$\frac{f1}{fo} = 1.59 \text{ (see derivation below)}$$

so that f1 must have frequencies greater than fo in the ratio 1.59 to obtain the correct compliance ratio when bonded.

Similarly, in the case of the monolithic cantilever actuator if the free cantilever is bonded by in effect a pin jointed end, bonding alters the resonant frequencies by $$\frac{f1}{fo} = 4.37 \text{ (see derivation below)}$$

so that fo and f1 can be similarly tracked to keep CR of the finished actuator at the design value after assembly. For a rigid bond in the cantilever actuator form $$\frac{f1}{fo} = 6.36$$

The ratio $$\frac{f1}{fo}$$

=1 or 1.59 for the chevron actuator with a pin jointed or rigid bond and the values $$\frac{f1}{fo}$$

of 4.37 or 6.35 in the pin jointed and rigid bond cases of the cantilever actuator are derived from a table "7.3 Natural Frequencies and Normal Modes of Uniform Beams" of values which appears at page 7–14 of Volume I of the text book "Shock and Vibration Handbook" edited by Cyril M. Harris and Charles E. Crede.

In the table referred to, it will be seen from column (E) that the frequency fo is proportional to k2 for an unclamped cantilever which is a proportion of (1.875)2 while f1 for the chevron type actuator with a rigid bond is the same proportion of the square of half of the clamped-clamped value of k which is $$4.730 \text{ so that } \frac{f1}{fo} = \frac{(4.730/2)^2}{(1.875)^2} = 1.59$$

The reason for taking one half of the clamped-clamped value of k is that with the chevron arrangement the length of the free cantilever beam is half that of the clamped-clamped beam.

Similarly, in the case of the cantilever arrangement the values of k for the pin jointed bond are taken from the clamped-hinged beam and the unclamped cantilever beam values so $$\text{that } \frac{f1}{fo} = \frac{(3.927)^2}{(1.875)^2} = 4.37$$

while for the rigid bond, the values of k are taken from the clamped-clamped beam and the unclamped cantilever beam values, so $$\text{that } \frac{f1}{fo} = \frac{(4.730)^2}{(1.875)^2}.$$

Thus, with the invention, a very convenient and accurate method for testing body components of a pulsed droplet deposition apparatus is made available. It is recognized that numerous changes and modifications in the described embodiments of the invention may be made without departure from its true spirit and scope. The invention is to be limited only as defined in the claims.

What is claimed is:

1. A method of testing body components of pulsed droplet deposition apparatus, said body components each comprising a piezo-electric sheet formed with an array of parallel droplet liquid receiving channels having upstanding parallel channel dividing side wall elements poled in a direction normal to said sheet and plated each on opposite, channel facing wall surfaces thereof with electrodes, said method comprising:

applying to each of said body components a variable frequency voltage at said electrodes of each of a number of selected wall elements thereof;

determining the natural frequency of said selected wall elements from the impedance variations experienced thereby in response to said variable frequency voltage;

evaluating from the natural frequency of each of said selected wall elements whether the compliance ratio of each of said selected wall elements and droplet liquid to be employed in said pulsed droplet deposition apparatus lies within a desired range of values; and accepting for production of bodies of said apparatus said body components of which said selected wall elements have respective compliance ratios with said droplet liquid lying within said desired range of values.

2. The method of claim 1 including the step of determining from the natural frequencies of said selected wall elements whether the compliance ratios thereof lie within a predetermined range of each other and accepting for production said body components of which said selected wall elements have respective compliance ratios lying within said predetermined range of each other.

3. The method of claim 1 including applying said variable frequency voltage to said electrodes of each of said side wall elements.

4. The method of claim 1 wherein the range $0.3 \leqq CR \leqq 3$ comprises said desired compliance ratio range of values.

5. The method of claim 4 wherein the range of $0.5 \leqq CR \leqq 0.67$ comprises said desired compliance ratio range of values.

6. The method of claim 1 including bonding to the channel dividing side wall elements of each of said accepted body components a further member to form part of said array of parallel channels, applying said variable frequency voltage to the electrodes of each of said wall elements to which said voltage was applied prior to said bonding step;

determining from impedance variations of each of said wall elements subject to said voltage the natural frequency thereof; and evaluating from the natural frequency of each of said wall elements determined after bonding thereto of said further member whether the compliance ratio thereof and of said droplet liquid lies within said desired range of values.

7. The method of claim 6 wherein the range $0.3 \leqq CR \leqq 3$ comprises said desired compliance ratio range of values.

8. The method of claim 7 wherein the range of $0.5 \leqq CR \leqq 0.67$ comprises said desired compliance ratio range of values.

9. The method of claim 1 including bonding together said side wall elements of two like body components accepted for production of bodies of said apparatus to form a body having an array of parallel channels, applying said variable frequency voltage to the electrodes of each of said wall elements of each of said like body components to which said voltage was applied prior to bonding together of said components; determining from impedance variations of each of said wall elements subject to said voltage the natural frequency thereof; and evaluating from the natural frequency of each of said wall elements determined after bonding of said components whether the compliance ratio of each of said components and droplet liquid lies within said desired range of values,

10. The method of claim 9 wherein the range $0.3 \leqq CR \leqq 3$ comprises said range of desired values of compliance ratio.

11. The method of claim 10 wherein the range $0.5 \leqq CR \leqq 0.67$ comprises said range of desired values of compliance ratio.

12. A method of testing body components of pulsed droplet deposition apparatus, said body components each comprising a piezo-electric sheet formed with an array of parallel droplet liquid receiving channels having upstanding parallel channel dividing side wall elements poled in a direction normal to said sheet and plated each on opposite, channel facing wall surfaces thereof with electrodes, said method comprising:

applying to each of said body components a variable frequency voltage at said electrodes of each of a number of selected wall elements thereof;

determining the natural frequency of said selected wall elements from the impedance variations experienced thereby in response to said variable frequency voltage;

evaluating from the natural frequency of each of said selected wall elements whether the compliance ratio of each of said selected wall elements and droplet liquid to be employed in said pulsed droplet deposition apparatus lies within a desired range of values;

determining from the natural frequencies of said selected wall elements whether the compliance ratios thereof lie within a predetermined range of each other; and accepting for production body components of which said selected wall elements have respective compliance ratios with said droplet liquid lying within said desired range of values and within said predetermined range of each other.

* * * * *